US008133062B2

(12) United States Patent
Li et al.

(10) Patent No.: US 8,133,062 B2
(45) Date of Patent: Mar. 13, 2012

(54) ELECTRICAL CONNECTOR ASSEMBLY HAVING TUBULAR CONTACT PIN PLUGGED AT OPEN END

(75) Inventors: Shuai Li, Kunshan (CN); Yung-Chang Cheng, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/951,079

(22) Filed: Nov. 22, 2010

(65) Prior Publication Data

US 2011/0124241 A1 May 26, 2011

(51) Int. Cl.
*H01R 12/00* (2006.01)

(52) U.S. Cl. ..... 439/76.1

(58) Field of Classification Search ..... 439/76.1, 439/490, 620.24, 493, 578
See application file for complete search history.

(56) References Cited

U.S. PATENT DOCUMENTS

| | | | | |
|---|---|---|---|---|
| 5,147,221 | A * | 9/1992 | Cull et al. | 439/585 |
| 6,729,912 | B2 * | 5/2004 | D'Addario | 439/675 |
| 7,374,455 | B2 * | 5/2008 | Purdy et al. | 439/578 |
| 7,568,937 | B2 * | 8/2009 | Fitzpatrick et al. | 439/404 |

OTHER PUBLICATIONS http://www.oddcables.com/faqs_crimp_solder.asp, date not availbale.*
https://www.kimballmidwest.com/Catalog/MarketingText/Ultra%020Link%20Terminals.pdf, Mar. 1999.*

* cited by examiner

*Primary Examiner* — Tulsidas C Patel
*Assistant Examiner* — Phuongchi Nguyen
(74) *Attorney, Agent, or Firm* — Andrew C. Cheng; Wei Te Chung; Ming Chieh Chang

(57) ABSTRACT

An electrical connector assembly comprises an insulative housing, a center pin having a first end protruding out of the insulative housing and a second end disposed in the insulative housing, a metallic sleeve enclosing the center pin for forming a receiving room therein and a protection member. The center pin is configured as a hollow structure and defines a center space therein with an opening at the second end thereof. The metallic sleeve comprises a solder portion disposed in the insulative housing. The protection member completely blocks the opening of the center pin.

16 Claims, 9 Drawing Sheets

ELECTRICAL CONNECTOR ASSEMBLY HAVING TUBULAR CONTACT PIN PLUGGED AT OPEN END

FIELD OF THE INVENTION

The present invention relates to a plug assembly, and more particularly to a plug assembly in which a contact pin disposed within the plug assembly is plugged at its rear end.

DESCRIPTION OF THE RELATED ART

An electrical connector assembly for transmitting audio or video signals is widely used in various electronic device, such as television, DVD Player, MP3 player and so on. The electrical connector assembly usually comprises an insulative housing, a tubular center pin held by the insulative housing and having a center space with an opening at an end thereof, a metallic sleeve held by the insulative housing and enclosing the center pin, a plurality of wires respectively terminated to the center pin and the metallic sleeve, and an overmold member covering the insulative housing and the ends of the wires. At present, the center pin and the metallic sleeve are inserted-molded in the insulative housing. Because the center pin has an opening thereof, the insulative material of the insulative housing may enter into the hollow space of the center pin through the opening during the molding process, as a result, once the plastic material enters the hollow space, it will make the center pin become rigid and lose its compliant capability. Hence, a new design which can solve the problem is required.

SUMMARY OF THE INVENTION

Accordingly, an object of the present invention is to provide an electrical connector assembly with a protection member.

In order to achieve the object set forth, an electrical connector assembly comprises an insulative housing, a center pin having a first end protruding out of the insulative housing and a second end disposed in the insulative housing, a metallic sleeve enclosing the center pin for forming a receiving room therein and a protection member. The center pin is configured as a hollow structure and defines a center space therein with an opening at the second end thereof. The metallic sleeve comprises a solder portion disposed in the insulative housing. The protection member completely blocks the opening of the center pin.

Other objects, advantages and novel features of the invention will become more apparent from the following detailed description of the present embodiment when taken in conjunction with the accompanying drawings.

DETAILED DESCRIPTION OF THE INVENTION

Figure 1:
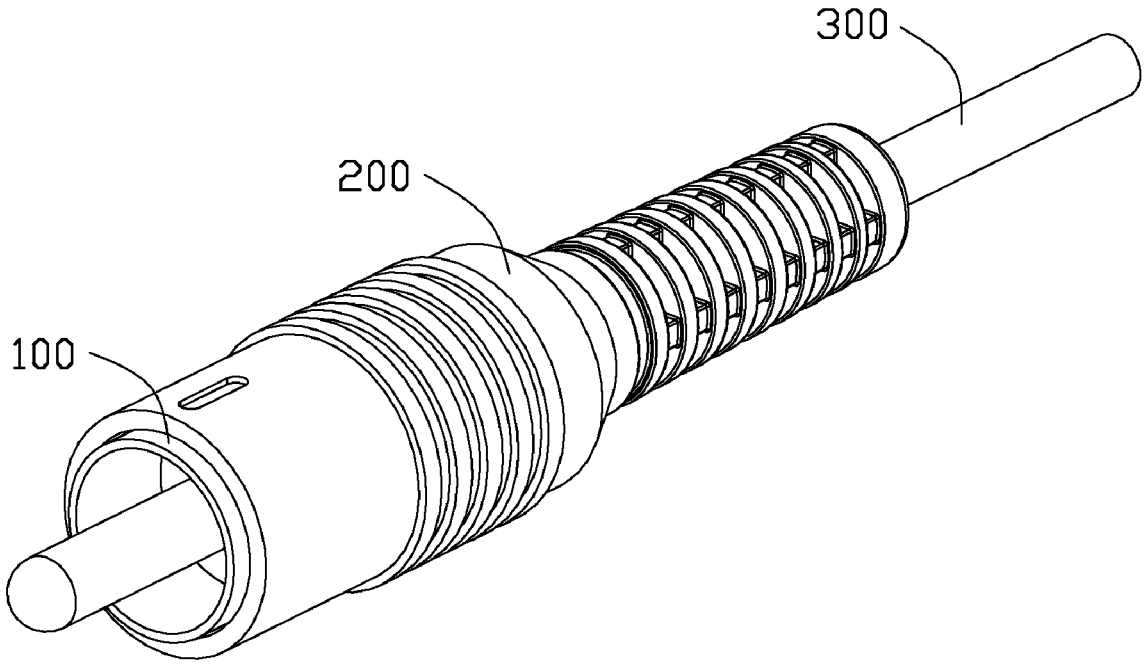
FIG. 1 is a perspective view of an electrical connector assembly in accordance with the present invention.

Reference will now be made to the drawing figures to describe a preferred embodiment of the present invention in detail. Referring to FIGS. 1 to 7, an electrical connector assembly according to a first embodiment of the present invention is provided.

Figure 3:
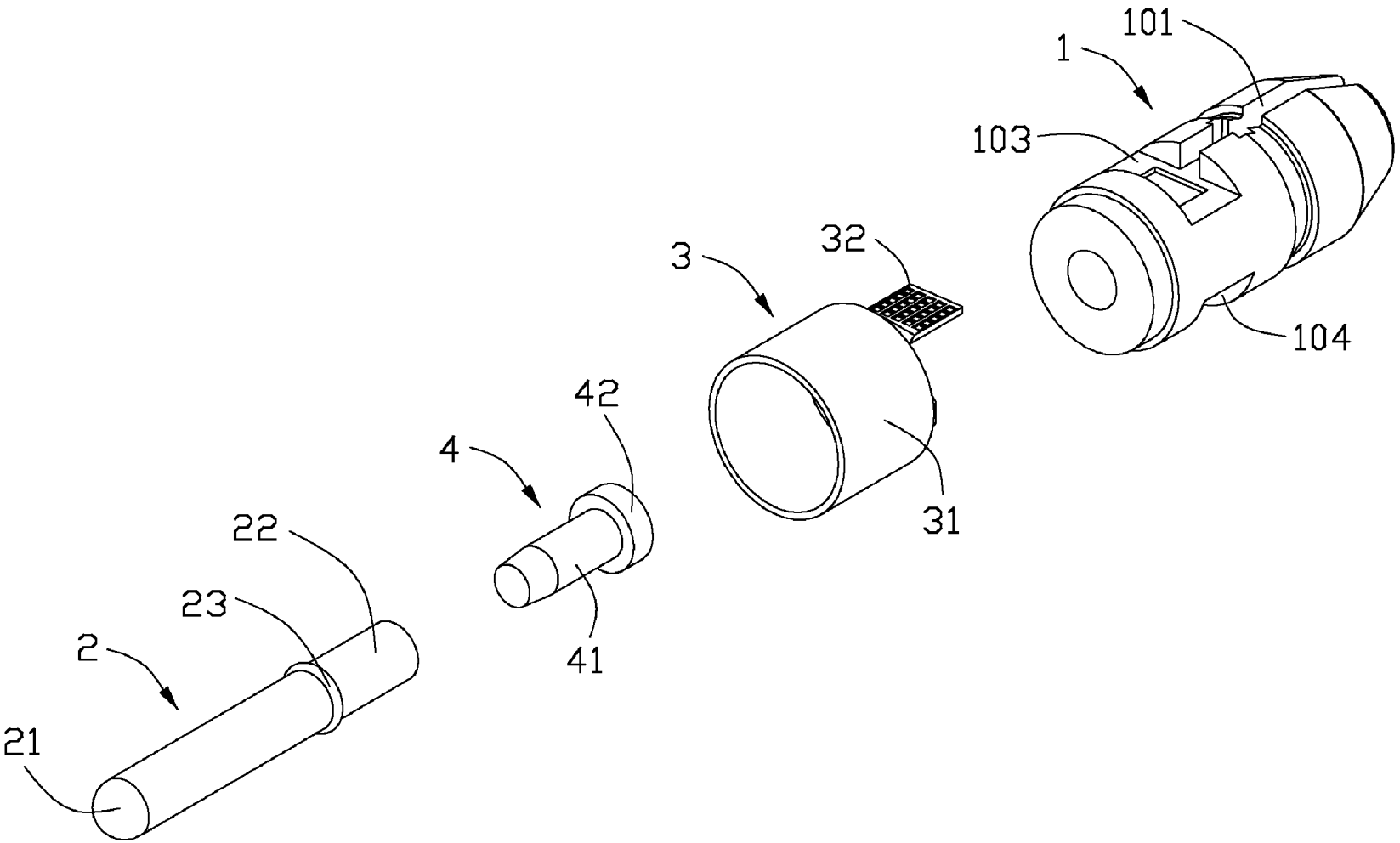
FIG. 3 is an exploded perspective view of a main body of the electrical connector assembly shown in FIG. 2.

Referring to FIG. 1 and FIG. 3, the electrical connector assembly comprises a main body 100, a coat member 200 covering the main body 100 and a cable 300 with two wires 301 for contacting with the main body 100.

Figure 4:
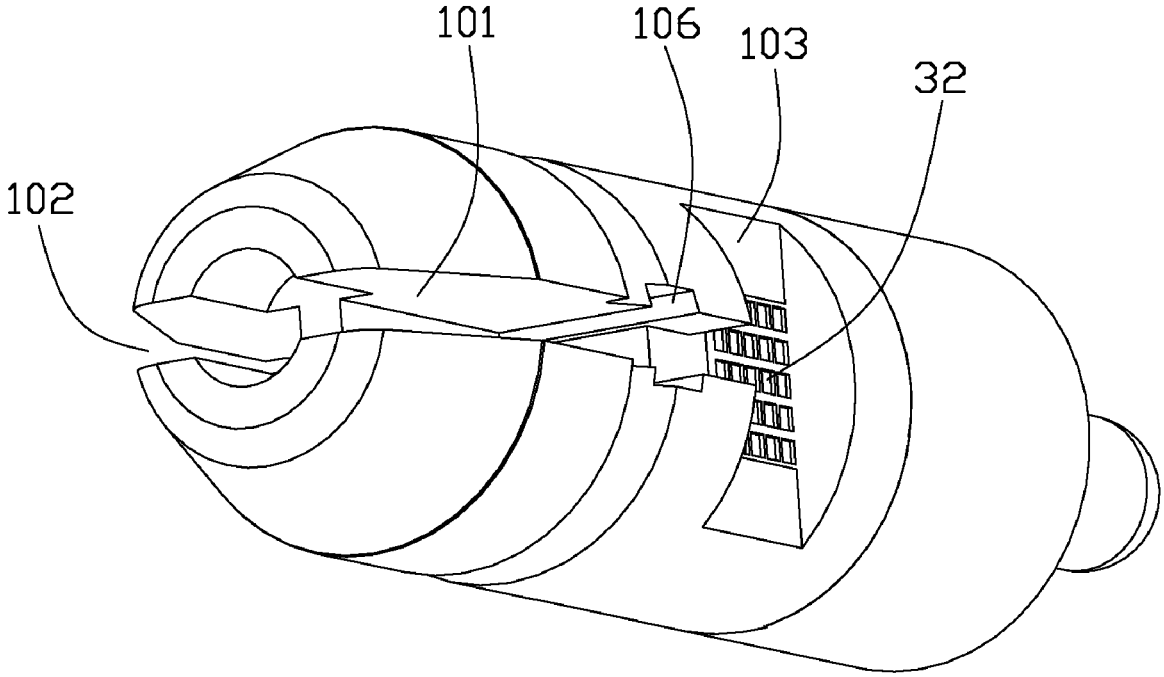
FIG. 4 is a perspective view of the main body of the electrical connector assembly shown in FIG. 3.
Figure 5:
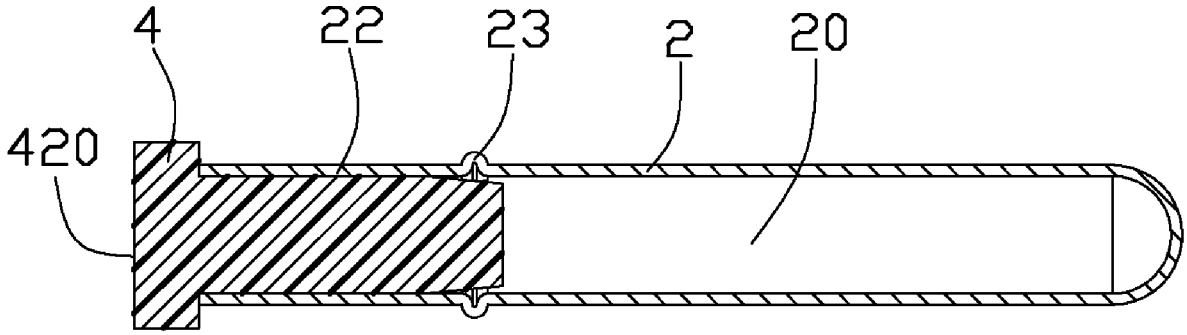
FIG. 5 is a cross-sectional view of a center pin of the electrical connector assembly with a protection member at one end thereof.

Referring to FIG. 3 and FIG. 4, the main body 100 comprise a housing 1, a center pin 2 disposed in the housing 1, a metallic sleeve 3 enclosing the center pin 2 and a protection member 4. The center pin 2 is tubular and comprises a first end 21, a second end 22 and a rib 23 closer to the second end 22 and protruding outwardly. Referring to FIG. 5, the center pin 2 is configured as a hollow structure and defines a center space 20 therein with an opening at the second end thereof. The protection member 4 can be inserted into the center space 20 via the opening. The protection member 4 comprises a head portion 42 and a tip portion 41 extending from the head portion 42. The tip portion 41 can be inserted into the center space 20 and the head portion 42 locates outside of the center space 20 to cover the opening of the second end. The tip portion 41 is short than a length of the center space 20, so the center space 20 is not fully stuffed by the tip portion 41. The center pin 2 can be distorted or bent appreciably duo to its own flexibility. The rib 23 can prevent the center pin 2 releasing from the housing 1. The metallic sleeve 3 comprises a tubular base 31 and a solder portion 32 extending from the base 31.

Before molding of the main body 100, the tip portion 41 of the protection member 4 is inserted into the center space 20, then the center pin 20 is placed in a mould and a die core is placed behind the head portion 42 of the protection member 4. Then plastic material is injected into the mould and the main body 100 is formed.

Figure 6:
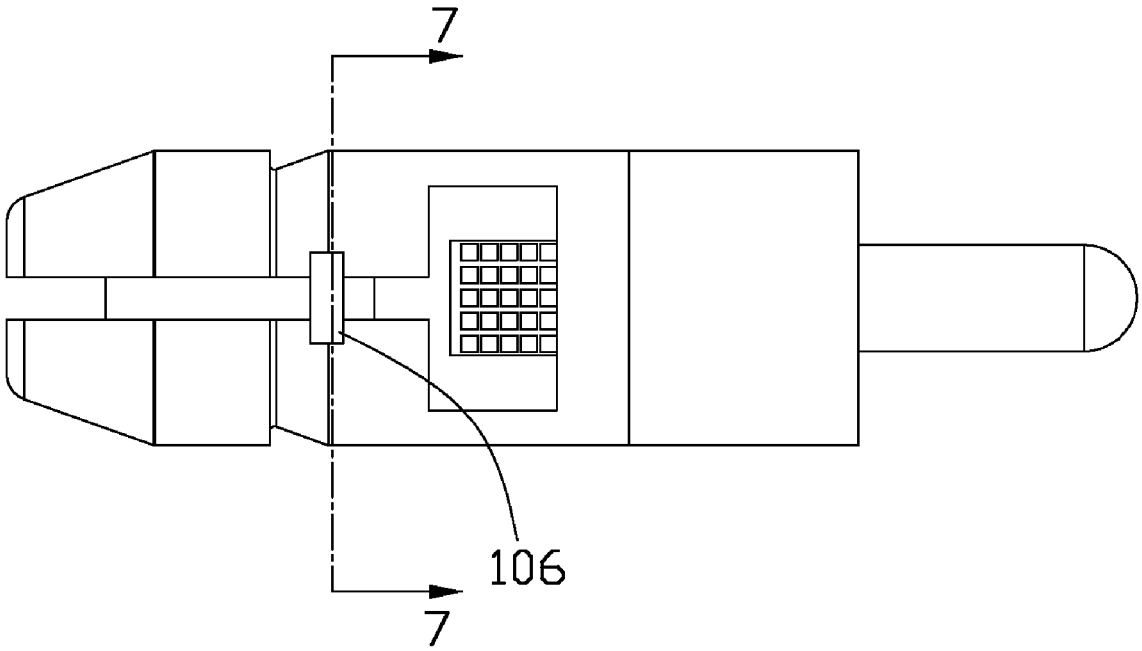
FIG. 6 is a perspective view of the main body seen from a right side.
Figure 7:
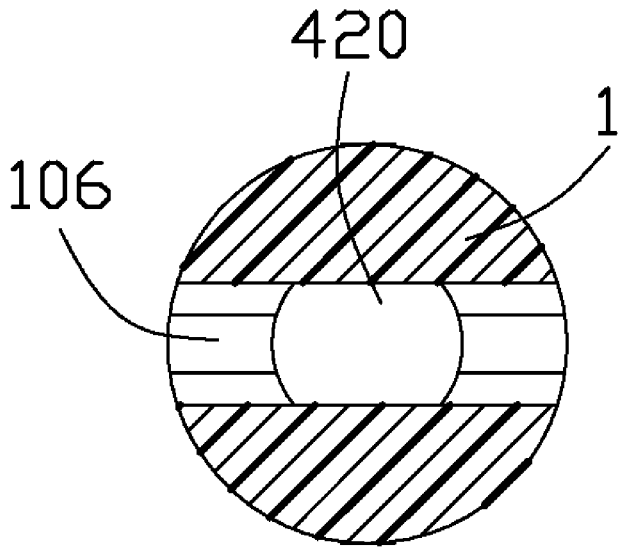
FIG. 7 is a cross-sectional view of the main body shown in FIG. 6 along line 7-7.
Figure 8:
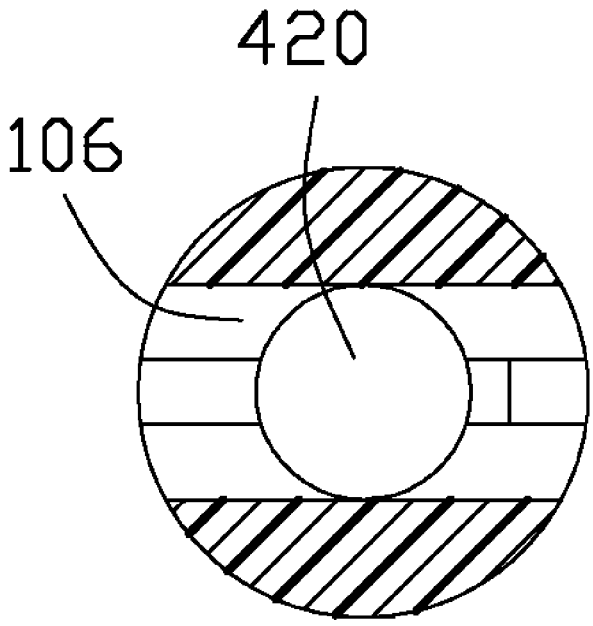
FIG. 8 is another embodiment of the main body shown in FIG. 7.
Figure 9:
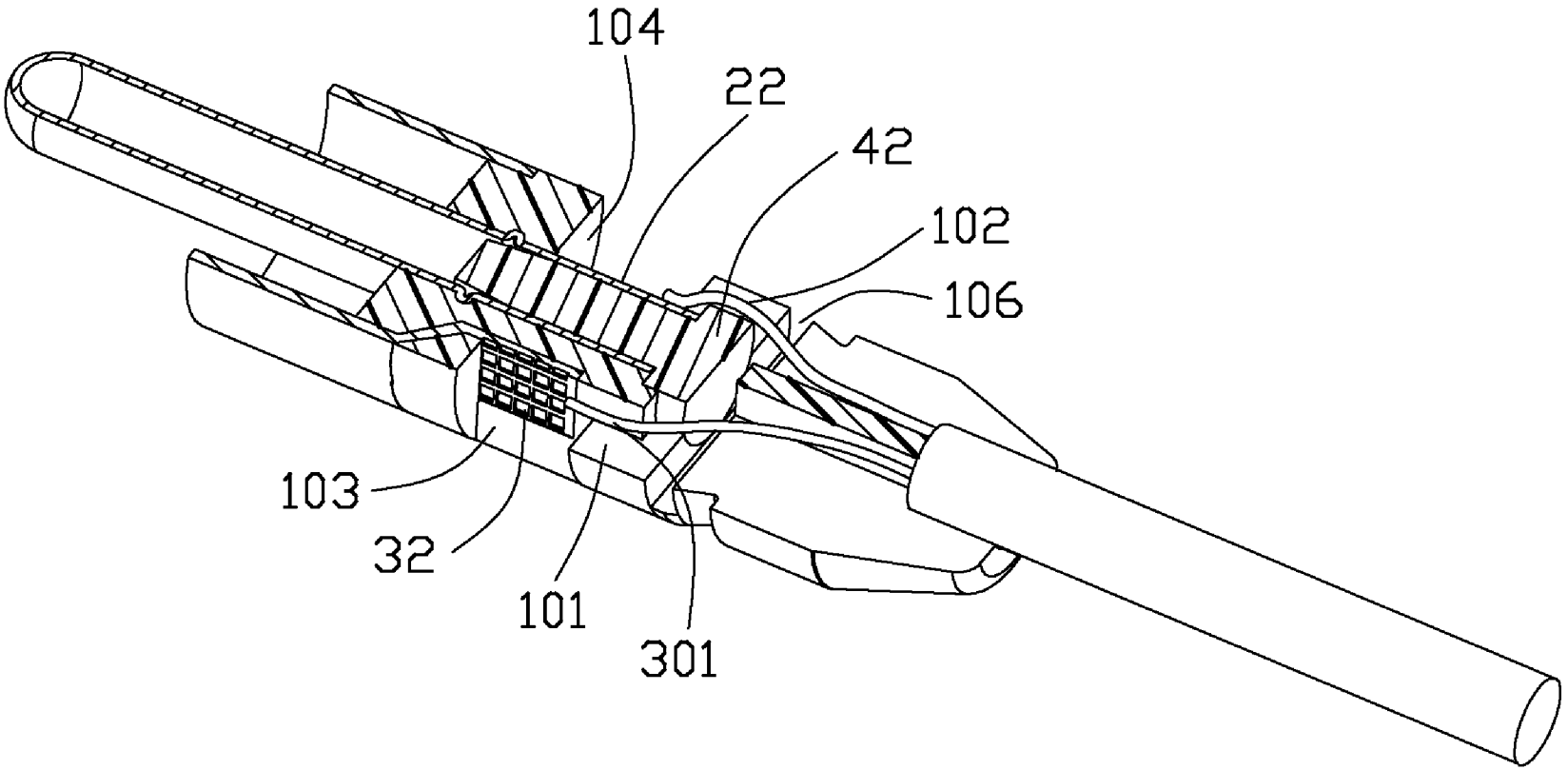
FIG. 9 is a partly cut out perspective view of the main body and a cable with a pair of wires contact thereto.

Referring to FIG. 3, FIG. 4 and FIG. 9, the main body 100 has a first channel 101 on a side thereof, a second channel 102 on another side thereof, a first hollow 103 communicating with the first channel 101 and a second hollow 104 communicating with the second channel 102. After molding, the second end 22 of the center pin 2 is disposed in the housing 1 and partly exposed in the second hollow 104, the first end 21 of the center pin 2 protrudes out of the housing 1, the solder portion 32 of the metallic sleeve 3 is held by the housing 1 and locates in the first hollow 103, and the tubular base 31 encloses the center pin 2 to form a receiving room 105 for receiving a mating electrical connector, which can be seen from FIG. 2. Referring to FIG. 6, FIG. 7 and FIG. 9, a gap 106 going through the housing 1 is formed, because during the molding process, the die core is placed behind the protection member 4. The width of the gap 106 is equal to the width of the die core. The die core can stop the flowing insulative material from running against the head portion 42 of the protection member 4, which can protect the head portion 42 being melted. The die core can be a small one to avoid the weakest portion of the head portion 42 being run against, in this condition, the width of the gap 106 is smaller, and a part of a back face 420 of the head portion 42 is exposed in the gap 106, as shown in FIG. 7. The die core can be a big one to avoid the whole back face 420 of the head portion 42 being run against, in this condition, the width of the gap 106 is bigger, and the whole back face 420 exposes in the gap 106 in a second embodiment as shown in FIG. 8 and FIG. 9.

Figure 2:
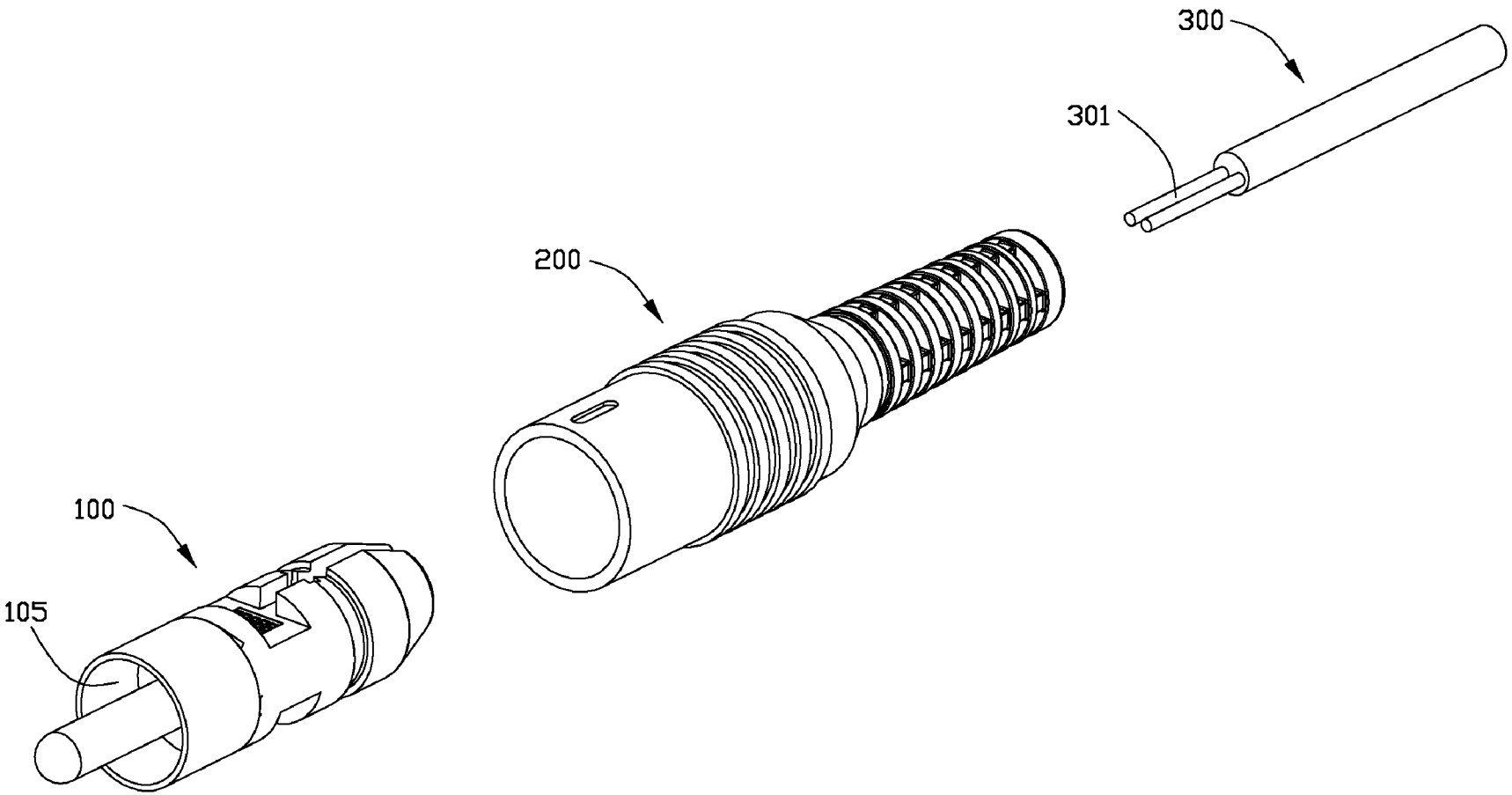
FIG. 2 is an exploded perspective view of the electrical connector assembly shown in FIG. 1.

Referring to FIG. 2 and FIG. 4, the cable 300 comprises a pair of wires 301. One of the wires 301 can electrically contact with the solder portion 32 of the metallic sleeve 3 via going through the first channel 101. The other wire 301 can electrically contact with the center pin 2 via going through the second channel 102.

Referring to FIG. 1, the coat member 200 covers the main body 100 and one end of the cable 300. Some ribs protrude outwardly from the coat member 200 for an operator to hold.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

an insulative housing;

a center pin disposed within the housing and having a first end protruding out of the insulative housing and a second end disposed in the insulative housing, the center pin being configured as a hollow structure and defining a center space therein with an opening at the second end thereof; and a metallic sleeve enclosing the center pin for forming a receiving room therein and comprising a solder portion disposed in the insulative housing;

wherein the electrical connector assembly further comprises a protection member completely blocking the opening of the center pin, wherein the insulative housing defines a first channel at one side thereof, a second channel at the other side thereof, a first hollow communicating with the first channel and a second hollow communicating with the second channel, the solder portion of the sleeve exposes in the first hollow and a part of the second end of the center pin exposes in the second hollow.

2. The electrical connector assembly as described in claim 1, wherein the protection member has a tip portion inserted into the center space but only occupying partly of the center space.

3. The electrical connector assembly as described in claim 1, wherein the center pin defines a rib at an exterior circumstance thereof and disposed in the insulative housing.

4. The electrical connector assembly as described in claim 1, wherein the metallic sleeve comprises a tubular base enclosing the center pin, and the solder portion extends from the base.

5. The electrical connector assembly as described in claim 1, further comprising a cable with at least two wires, one of the wires contacts with the solder portion of the sleeve and the other contacts with the center pin.

6. The electrical connector assembly as described in claim 5, further comprising a coat member covering the insulative housing.

7. An electrical connector assembly comprising:

an insulative housing;

a center pin having a first end protruding out of the insulative housing and a second end disposed in the insulative housing, the center pin being configured as a hollow structure and defining a center space with a opening at the second end thereof;

a metallic sleeve enclosing the center pin for forming a receiving room therein and comprising a solder portion disposed in the insulative housing; and a protection member having a tip portion plugging into a portion of the center space via the opening and a head portion locating outside of the center pin; wherein the insulative housing has a gap thereon, in which at least a part of the head portion of the protection member is exposed.

8. The electrical connector assembly as described in claim 7, wherein the center pin has a rib embedded in the insulative housing.

9. The electrical connector assembly as described in claim 7, wherein the metallic sleeve comprises a tubular base enclosing the center pin, and the solder portion extends from the base.

10. The electrical connector assembly as described in claim 7, wherein the insulative housing defines a first channel at one side thereof, a second channel at the other side thereof, a first hollow communicating with the first channel and a second hollow communicating with the second channel, the solder portion of the sleeve exposes in the first hollow and a part of the second end of the center pin exposes in the second hollow.

11. The electrical connector assembly as described in claim 7, further comprising a cable with at least two wires, one of the wires contacts with the solder portion of the sleeve, and the other contacts with the center pin.

12. The electrical connector assembly as described in claim 11, further comprising a coat member covering the insulative housing.

13. An electrical connector comprising:

an insulative housing defining a center hole and first and second channels radially and outwardly communicating to an exterior;

a center pin extending along an axial direction and defining a tubular structure with a sealed front end thereof, a rear section of the center pin disposed within a front portion of the housing and a front section of the center pin extending forwardly beyond a front face of the housing;

a stopper discrete from the center pin and assembled to a rear section of the center pin to block a rear end of said center pin; and a metallic shell coaxially enclosing the front section of the center pin and the front portion housing; wherein the center pin and the housing are assembled via an insert molding process, and the first channel communicates with the center pin, and the second channel communicates with the metallic shell for connecting to corresponding wires, respectively; and wherein said center pin is equipped with a circumferential rib around the rear section to be embedded within the front portion of the housing.

14. The electrical connector as claimed in claim 13, wherein said stopper forwardly extends into the center pin and cooperates with the housing to sandwich said circumferential rib therebewteen radially.

15. The electrical connector as claimed in claim 13, wherein the housing further includes a gap communicating the center hole with the exterior radially behind the stopper under condition that said gap intersects with one of the first channel and the second channel.

16. The electrical connector as claimed in claim 15, wherein said gap extends in a transverse direction perpendicular to an axial direction of the center pin, and is dimensioned with a width in said transverse direction in compliance with a diameter of said stopper.

* * * * *